US005456151A

United States Patent [19]

Enserink

[11] Patent Number: 5,456,151

[45] Date of Patent: Oct. 10, 1995

[54] LOCKING APPARATUS FOR A STRING

[75] Inventor: Anton R. Enserink, Wassenaar, Netherlands

[73] Assignee: Enserink Innovation B.V., Wassenaar, Netherlands

[21] Appl. No.: 256,515

[22] PCT Filed: Jan. 8, 1993

[86] PCT No.: PCT/NL93/00007

§ 371 Date: Sep. 7, 1994

§ 102(e) Date: Sep. 7, 1994

[87] PCT Pub. No.: WO93/14489

PCT Pub. Date: Jul. 22, 1993

[30] Foreign Application Priority Data

Jan. 9, 1992 [NL] Netherlands ..... 9200031

[51] Int. Cl.[6] ..... G10D 3/00

[52] U.S. Cl. ..... 84/297 R

[58] Field of Search ..... 84/297 R, 314 N, 84/454

[56] References Cited

U.S. PATENT DOCUMENTS 4,574,678 3/1986 Edwards ..... 84/314 N 4,667,561 5/1987 Storey et al. ..... 84/314 N

*Primary Examiner*—David M. Gray

*Assistant Examiner*—Patrick J. Stanzione

*Attorney, Agent, or Firm*—Young & Thompson

[57] ABSTRACT

A locking apparatus (1) for a string of a stringed instrument, which locking apparatus includes a locking cam (20, 23–27) arranged rotatably about a point of rotation and a locking wall, which locking cam and locking wall are positioned relative to each other in such a way that a string can be locked between them. The rotatably arranged cam is an eccentric made from a hard and stiff material, placed in a U-shaped channel of a hard and stiff beam (3). This channel contains the locking wall. A small spring holds the locking cam to the locking wall in case no string is present between the locking wall and the locking cam. The eccentric is shaped in such a way that the locking cam and the locking wall contact at only one point, in case there is no string between them.

13 Claims, 5 Drawing Sheets

LOCKING APPARATUS FOR A STRING

FIELD OF INVENTION

The invention relates to a locking apparatus for a string of a stringed instrument, which also includes a tuning mechanism for the string, which locking apparatus includes a locking cam arranged rotatably about a point of rotation and a locking wall, which locking cam and locking wall are positioned relative to each other in such a way, that a string can be locked between them.

BACKGROUND OF THE INVENTION

Such a locking apparatus for a string of for instance a violin or a guitar is known from U.S. Pat. No. 1,732,172. This known apparatus composes a joint construction with means to tune the individual strings of the stringed instrument. Therefore, the string is guided through an opening in a channel of a tuning means. In order to anchor the string to the stringed instrument the string is subsequently pulled out of the other side of the tuning means. Subsequently, the string is anchored to the locking means. The locking apparatus includes a rotatably arranged locking cam and a locking wall, between which the end of a string can be guided. Both the locking cam and the locking wall in the known apparatus, preferably, include a toughened surface. The locking cam and the locking wall are shaped in such a way, that, when the string is being pulled in the direction of the other end of the string, the locking cam and the locking wall seize and lock the string. Thereby the tensioned string is in direct physical contact with the locking cam over such an extent of the locking cam that the tension of the string provides for a leverage to the rotatably arranged locking cam and increases the locking force of the locking apparatus. In order to use the tuning means, the locking apparatus has to be guided into the channel of the tuning means, while the string remains tensioned. After the string is anchored on its other end, the locking apparatus can be moved through the channel of the tuning means by means of a butterfly nut, in order to regulate the tension in the spring.

In the known locking apparatus the locking cam is not provided with a spring, so that the locking cam, whenever no tensioned spring is inserted, will dangle without taking any defined position. Moreover, when a loose string is guided between the locking cam and the locking wall, the string will not yet be locked. The will only remain locked tight in the locking apparatus when the string is tensioned. By insertion of the string into the locking apparatus in the channel of the tuning means, therefore, the string has to maintain a certain tension, otherwise the string may still slip from the locking apparatus. In case the string as yet slips loose, the whole procedure has to be repeated, which consumes a lot of time. When, for instance during a concert, a string breaks the known apparatus is very unpractical, since changing a string takes a lot of time. This is certainly true, when the string slips loose from the locking apparatus in between. This known apparatus therefore is more suitable for violins, where the strings have a lower tension and are made of a rougher material than strings for a steel string guitar.

The object of the locking apparatus according to the present invention is to solve the problems mentioned above.

SUMMARY OF THE INVENTION

Therefore, the locking apparatus according to the invention is characterized in that the rotatably arranged locking cam is an eccentric from a hard and stiff material, placed inside a U-shaped channel being freely accessible from one side and provided in a hard and stiff beam, which channel includes the locking wall, a small spring being provided holding the locking cam to the locking wall in case no string is present between the locking cam and the locking wall, and the eccentric is shaped in such a way that the locking cam and locking wall contact at only one point in case there is no string in the channel.

By using a U-shaped, hard and stiff channel in combination with a hard and stiff eccentric which is pushed or pulled towards the locking wall in the channel by means of a spring, a locking apparatus of high quality results, with which the string can be locked most tightly, and with which the string can consequently be tensioned to a very high tension. This locking apparatus can be applied at one end of the string, while the tuning means is on the other side of the string. Therefore, this locking apparatus is highly suitable for use together with a tremolo apparatus, in which the tuning means for a string is placed. The U-shape of the channel makes the channel easily accessible for a string to be anchored, so that a broken string can be substituted quickly and easily during a concert. By providing the locking cam with a small spring, the string will also remain locked in the locking apparatus in case the string tension is strongly decreased. This, for instance, happens when the stringed instrument is provided with six strings that are anchored at one side to a tremolo, which tremolo is activated after breakage of one of the strings to release the tension from the remaining strings in order to attach a new string. The springs hold the five strings, which are then unloaded for a short period of time, in their original position in the locking apparatus, so that they do not need to be tuned again, after the tremolo has returned to its neutral position.

It may be noted that from FIG. 5 from the prior art the application of an eccentric is known. However, this is used in combination with a second eccentric, which is placed mirrorwise opposite to the first eccentric. Both eccentrics can rotate about their own axis, and can lock a string in between them. Here also counts, that the string is only locked, when a certain tension is applied to the string. If not, then the string will slip loose from between the two eccentrics which are not provided with springs and consequently have no initial locking load and no well defined initial position. As with the above mentioned known locking apparatus this locking apparatus is problematic when it has to be inserted in the channel of the tuning means, because in that situation the string has to remain loaded with a certain tension in order to prevent it from slipping loose from the locking apparatus.

BRIEF DESCRIPTION OF THE DRAWINGS

The invention will further be explained with reference to the drawings, which only serve as an illustration and not as a restriction of the idea of the invention.

In the drawing.

DETAILED DESCRIPTION OF THE INVENTION

Figure 1:
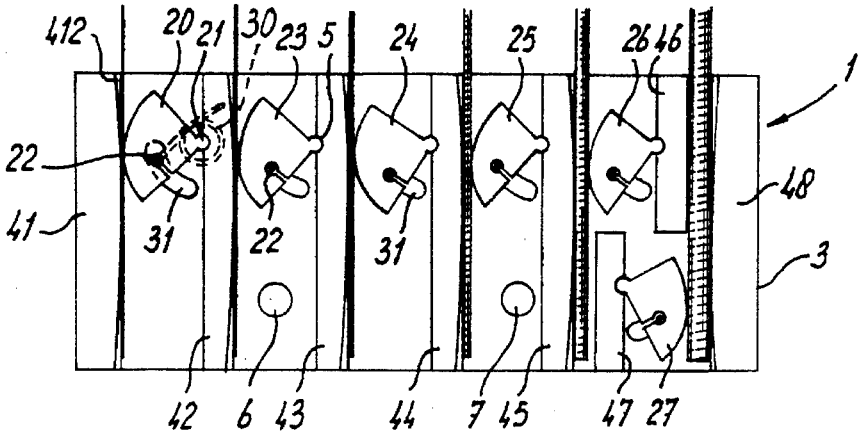
FIG. 1 shows a locking apparatus according to the invention for a total of six strings.

In FIG. 1 a locking apparatus 1 according to the invention is shown as a beam 3 provided with six U-shaped channels. Each channel is destined to hold one string. Of course the invention is not restricted to a beam 3 having six channels; the invention also relates to beams with n U-shaped channels, with $n \geqq 1$. In each channel a locking cam 20, 23–37 is located, having the shape of an eccentric and provided with a turning point 21 that fits into and interacts with a rotation cavity 5 placed in the inside walls 42–47 of each channel. Inside each U-shaped beam, the wall opposite to the wall provided with the rotation cavity 5 comprises a locking wall (for instance 411 in FIG. 2). Each locking cam is provided with an opening 22 through the locking cam. A spring can be placed in opening 22, in such a way that the locking cam is pushed or pulled against the locking wall in case there is no string present between the locking wall and the locking cam. In practice, the top of the beam does not provide enough space for such a spring 30. Therefore, beam 3 is provided, inside each channel, with slots 31, so that the springs 30 can be attached underneath the locking cams 20, 23–27 at the bottom side of beam 3. The springs can be attached more or less floating, as shown in the drawing. It is also possible to insert a bolt or axle (not shown) to each spring 30, around which the spring 30 can rotate.

Figure 9:
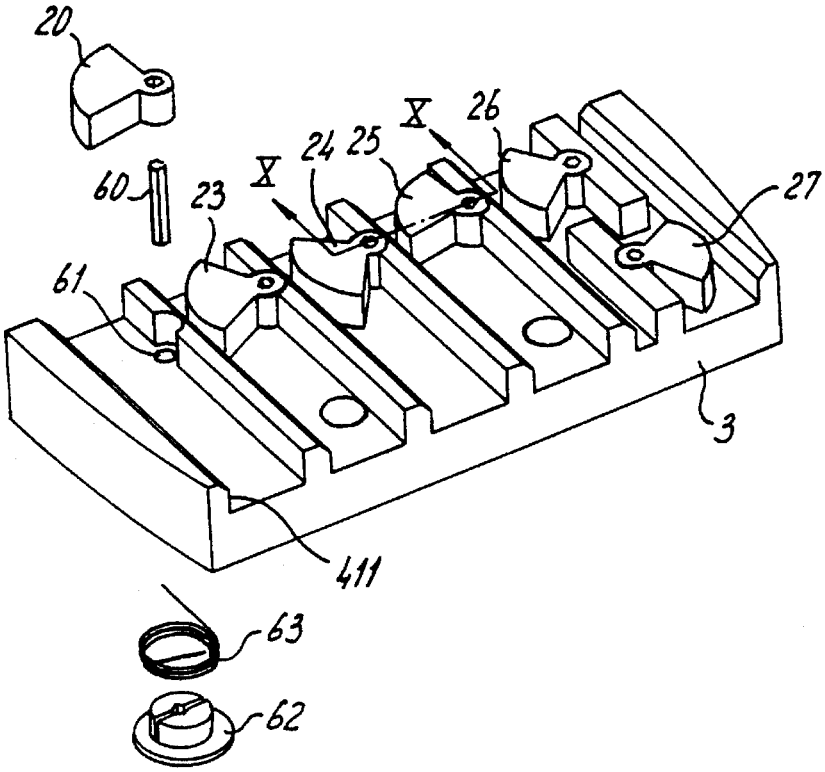
FIGS. 9 and 10 show a locking apparatus provided with a special spring design of the locking cams.
Figure 10:
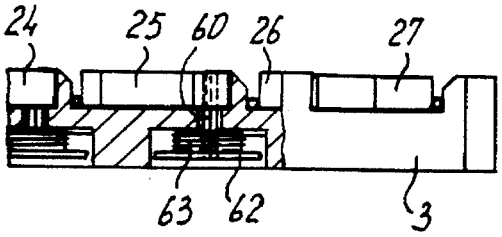

Other designs for spring 31 are also possible, as shown in FIGS. 9 and 10. Here, the locking cam 20 is provided with an axle 60, that rotates together with the locking cam 20 and is inserted in an opening 61 through beam 3. At the bottom side of the beam axle 60 is connected to a, preferably plastic, retainer 62, in such a way, that the plastic retainer 62 follows every rotation of locking cam 20. A spring 63 is connected to the plastic retainer 62, in such a way that in the initial position locking cam 20 is pushed against the locking wall 411. An appropriate cavity for plastic retainer 62 and spring 63 may be provided at the bottom side of beam 3, so that they do not protrude from the beam 3. In the preferred embodiment according to FIG. 9, similar spring designs are provided for the remaining locking cams 23–27. An advantage of the spring design 60–63 is, that it is easier to assemble than spring construction 30–31 according to FIG. 2. FIG. 10 shows a cross section along line X—X of FIG. 9.

Between the locking wall 411 and the locking cam 20 a string is installed by sliding the string along the bevelled edge 412 of locking wall 411 between the locking cam and the locking wall, in order to overcome the resilience of the small spring 30. The torque of small spring 30 has to be of a very low level, otherwise the string will not slide easy enough between the locking cam and the locking wall during installation. The String will then be locked with an initial clamping stress by spring 30, if the spring itself is not yet tensioned. The beam 3 can be mounted to the stringed instrument with screws or bolts 52 through mounting holes 6 and 7. Preferably, the beam is positioned immediately behind the top nut 50 of the stringed instrument (see FIG. 8).

The beam 3 is preferably made from quenched quality steel, known under the tradename: 'RUS', that can be quenched up to about 60 HRc. The locking cam is preferably made from rolled spring steel, class C, with a specific hardness of circa 56 HRc. A possible production method is 2D electro-erosive metal removing, although this method is rather expensive. A cheaper and quicker method is based on laser cutting, which method also provides a better controllable surface condition. In principle, it is possible also to laser cut the hole 22 for spring 30. Therefore, the laser-beam follows the contour of the locking cam and cuts in at slot s1 (FIG. 3) to make hole 22. This process is rather complex and not fully reliable because of the high local heat development. It is easier to pierce hole 22 with the laserbeam directly into the locking cam. In that case, slot s1, as shown in FIGS. 1,3,5 and 6, is not present at all.

Figure 2:
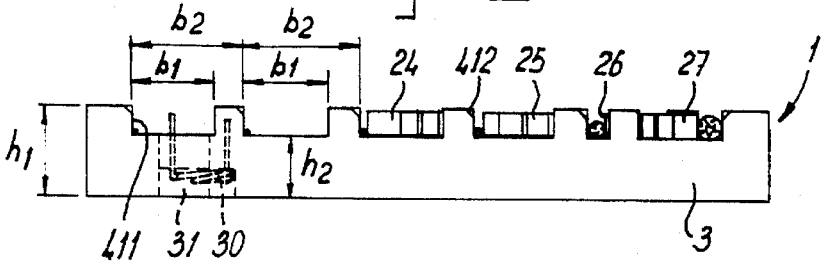
FIG. 2 shows a cross section through the locking apparatus according to FIG. 1.

FIG. 2 shows appropriate dimensions for beam 3. The overall height h1 is, for instance, 6 mm, while the height h2 of beam 3 underneath the channels is, for instance, 4 mm. The height of the locking cams is designed in such a way, that it is a fraction lower than the height of the raised walls 41 . . . 48 to prevent the cams from being locked in between the beam 3 and a cover 51 (FIG. 8) being placed over it. The tolerance between the locking cams and the cover 51 has to be small such that even the string with the lightest gauge cannot slip underneath a locking cam during the installation of the string or afterwards. The width b1 of each channel at a locking cam 2 measures approximately 5.5 mm, while the width b2 of a complete channel measures 7.5 mm. This width b2 corresponds with the standard spacing between two adjacent strings of a steel string guitar. When these dimensions are used, which provide beam 3 with sufficient stiffness, then a symmetrical design of beam 3, which is not allowed to be wider than the neck of the stringed instrument, for instance, an electric guitar, would not leave enough space for a channel at one of the sides of the beam 3. In order to prevent beam 3 from protruding from the neck of the stringed instrument a design is chosen for one of the ends of beam 3, as shown in FIG. 1. The locking cams 26, 27 on the right hand side of FIG. 1 each rotate in their own wall 46, 47 measuring only half of the length of the other walls 41–45, 48. It is observed that the right hand side locking cam 27 therefore is placed reversely in the channel related to the other locking cams 20, 23–26, concerning both the position of the rotation point and the position of its top and bottom surface.

Figure 3:
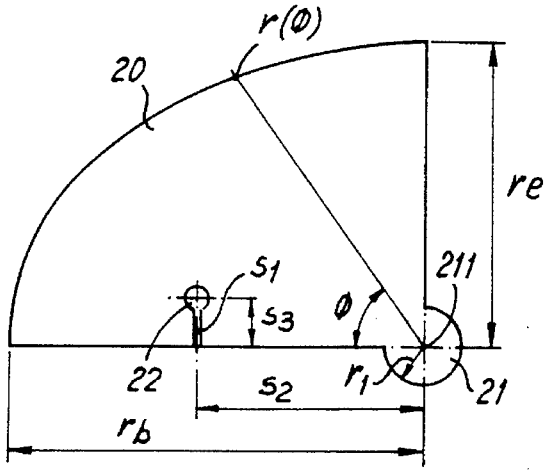
FIG. 3 shows a top view of the locking cam according to the invention.

FIG. 3 shows a top view of the locking cam in more detail. The locking cam 20 can rotate about rotation point 21 having centre 211. The distance between centre 211 and the edge of the locking cam with which the string is being locked, depends on the angle $\phi$ and is indicated with $r(\phi)$. Furthermore, the curve of $r(\phi)$ depends on the type of string that has to be locked. The fact is, it is found that the relationship of the dimensions of the eccentric for a wound string are preferably chosen different from the dimensions for plain strings. When, for instance, in a guitar, three plain strings and three wound strings are applied, then three eccentrics for plain strings and three eccentrics for wound strings are applied. For a wound string the dimension rb, i.e. $r(\phi)$ with $\phi=0$, is 5.5 mm. The dimension re, i.e. $r(\phi)$ for $\phi$ a little over $\pi/2$, measures in that case 4.0 mm. Slot s1, when present, measures less than 0.2 mm. The distance s2 between slot s1 and the centre 211 measures 3.0 mm. Radius r1 of the rotation point measures 1.0 mm, while the width of opening 22 is 0.5 mm. Finally, the dimension of s3 measures 1.0 mm. These dimensions are applied for wound strings. For a plain string, radius re is preferably 4.75 mm, the other dimensions being equal to those of the locking cam for wound strings.

Figure 5:
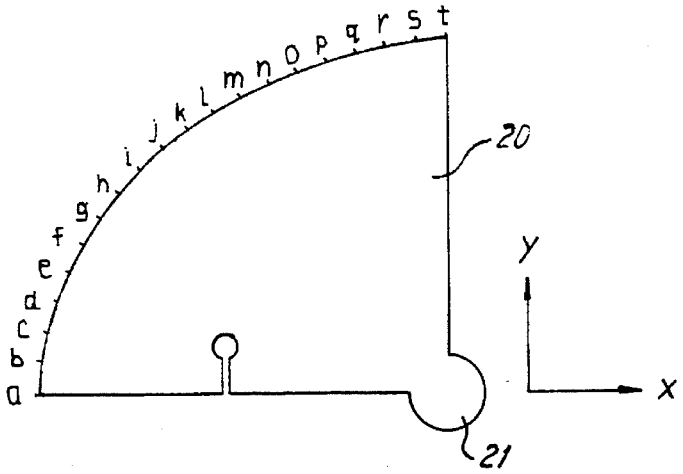
FIGS. 5 and 6 show two locking cams having different dimensions.
Figure 6:
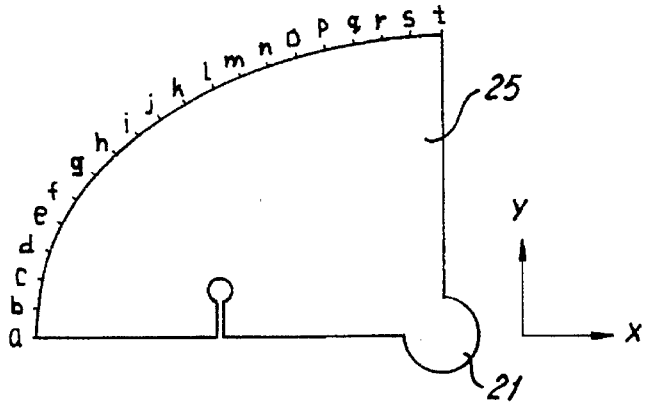

FIG. 5 shows a top view of a locking cam for plain strings, referred to as p-type locking cam, while FIG. 6 shows a top view of a locking cam for wound strings, referred to as w-type locking cam. The curvature of both eccentrics is different, as explained above. In a preferred embodiment of both eccentrics the points a to t follow the coordinates, as shown in table 1. In both cases point a is chosen as origin.

Figure 7:
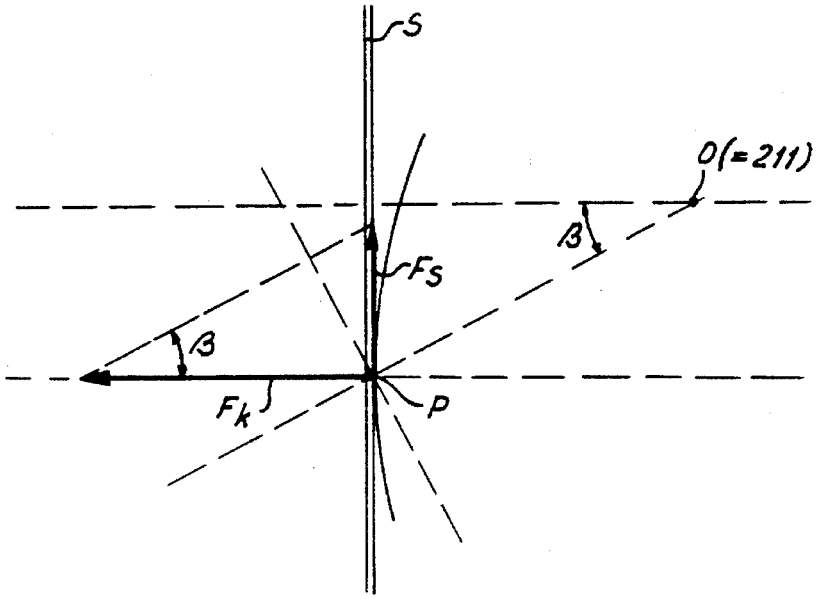
FIG. 7 shows a graph showing the relation between the locking force on the string and the tension in the string.

FIG. 7 shows how the value of locking force Fk on the string depends on the position P where the string S is locked between the locking cam and the locking wall. Point O is for instance equal to the centre 211 of rotation point 21 of locking cam 20. The line connecting points O and P makes an angle β to the line through O perpendicular to the locking wall and, consequently, to string S. When the string is loaded with a tension Fs, it corresponds with said locking force Fk according to the following formula:

$$F_k = F_m / \tan \beta$$

By choosing a small angle β, the locking force can be increased to an extremely high extent.

Figure 4:
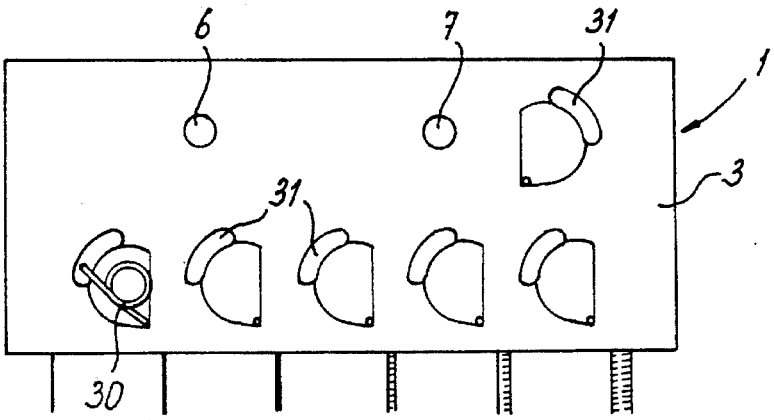
FIG. 4 shows a bottom view of the locking apparatus according to FIG. 1.
Figure 8:
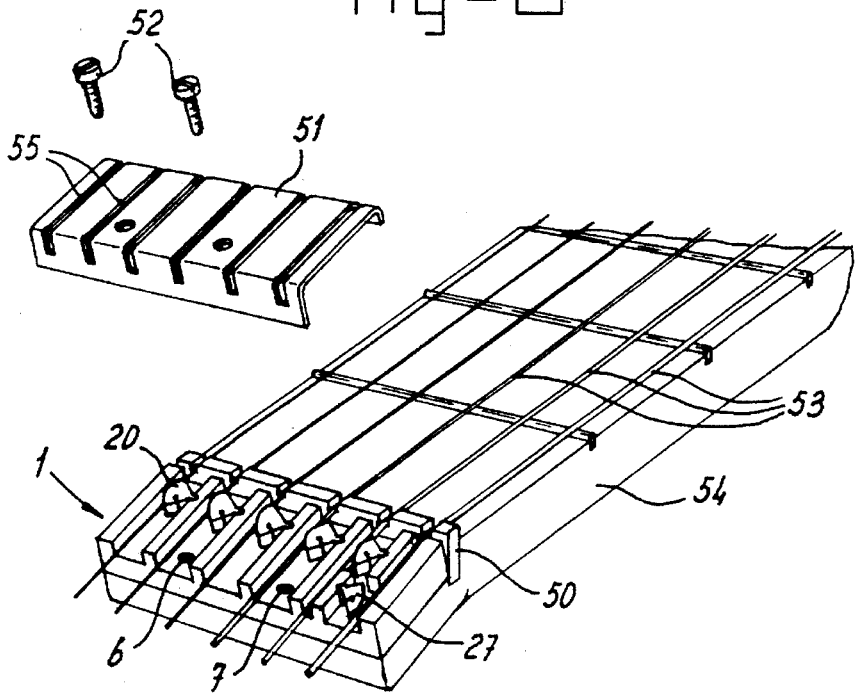
FIG. 8 shows a perspective view of the locking apparatus attached to the neck of a guitar.

FIG. 4 shows a bottom view of beam 3, with the cavities 31 for the springs 30 and the openings 6 and 7 for the mounting means clearly visible, whereas FIG. 8 shows where the locking apparatus according to the invention is placed on guitar neck 54.

FIG. 8 shows the guitar neck 54 with six strings 53. Immediately behind top nut 50 the locking apparatus 1 is placed, locking six strings 53. A cover-guiding plate 51 is provided to cover locking apparatus 1. Six guiding slots 55 are provided in cover-guiding plate 51, one for each string 53, and two holes for the mounting screws or bolts 52 are provided, with which mounting screws 52 the locking apparatus including the cover-guiding plate 51 is fixed to the guitar neck 54.

TABLE 1

Coordinates of a locking cam type W and type P (in mm relative to origin a)

| | locking cam type 'W': | | locking cam type 'P': | |
|---|---|---|---|---|
| | X: | Y: | X: | Y: |
| a | 0.0 | 0.0 | 0.0 | 0.0 |
| b | 0.101 | 0.472 | 0.061 | 0.476 |
| c | 0.241 | 0.927 | 0.162 | 0.941 |
| d | 0.419 | 1.361 | 0.303 | 1.391 |
| e | 0.632 | 1.772 | 0.482 | 1.825 |
| f | 0.878 | 2.155 | 0.696 | 2.238 |
| g | 1.153 | 2.510 | 0.944 | 2.628 |
| h | 1.453 | 2.833 | 1.223 | 2.992 |
| i | 1.777 | 3.124 | 1.531 | 3.327 |
| j | 2.120 | 3.380 | 1.864 | 3.632 |
| k | 2.479 | 3.600 | 2.221 | 3.904 |
| l | 2.850 | 3.784 | 2.596 | 4.142 |
| m | 3.230 | 3.932 | 2.988 | 4.345 |
| n | 3.615 | 4.042 | 3.393 | 4.510 |
| o | 4.000 | 4.116 | 3.808 | 4.639 |
| p | 4.387 | 4.153 | 4.229 | 4.730 |
| q | 4.768 | 4.153 | 4.653 | 4.783 |
| r | 5.139 | 4.124 | 5.077 | 4.798 |
| s | 5.500 | 4.060 | 5.497 | 4.777 |
| t | 5.847 | 3.965 | 5.911 | 4.732 |

Figure 11:
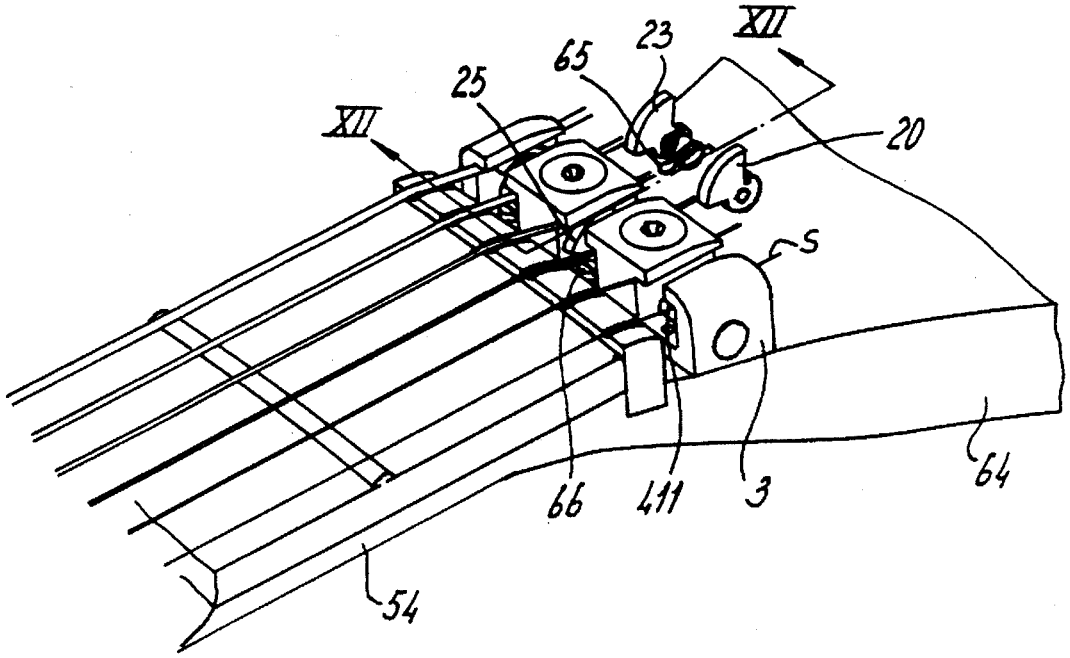
FIGS. 11 and 12 show another embodiment of the locking apparatus.
Figure 12:
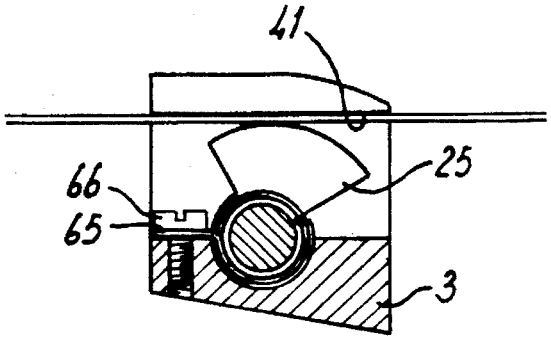

FIGS. 11 and 12 show, that the locking cams 20, 23–27 do not necessarily have to be positioned parallel to the top plane of beam 3. They may, for instance, also be positioned with an angle of about 90° relative to beam 3 and, consequently, also relative to neck 54 of a guitar. In this case the U-shaped channel in which the locking cam 20 is placed, is rotated 90° relative to the designs according to the preceding figures. The string s in the design according to FIG. 10, after being placed between locking cam 20 and locking wall 411, can be tightened by pulling the loose end of the string (in the figure at the right from beam 3) away from the guitar neck 54. This is also valid for the other strings as well. Consequently, the advantage is provided, that a headstock 64 can be attached to the guitar neck 54, which is optically preferred above a guitar neck without a headstock. With the locking apparatus 1 according to the preceding figures the strings have to be tightened by pulling them towards the bottom of beam 3, which can be seen referring to FIG. 8. Therefore, in that design a headstock is not possible.

FIG. 12 shows a cross section along the line XII—XII in FIG. 11 alongside locking cam 25. Between two adjacent locking cams, 20/23, 24/25, 26/27, each time one appropriately wound spring 65 can be provided, which, for instance, is anchored to the beam 3 with a bolt 66 and has two loose ends. Each end is connected to one locking cam, so that each spring 65 can push subsequently two locking cams 20/23, 24/25, 26/27 with an appropriate load towards locking wall 411.

I claim:

1. String locking apparatus of a stringed instrument, which also includes a tuning means for a string, which locking apparatus includes a locking cam arranged about a point of rotation and a locking wall, which locking cam and locking wall are positioned relative to each other in such a way, that a string can be locked between them, characterized in that the rotatably arranged locking cam is an eccentric from a hard and stiff material, placed in a U-shaped channel being freely accessible from one side and provided in a hard and stiff beam, which channel includes the locking wall, a small spring being provided holding the locking cam to the locking wall in case no string is present between the locking wall and the locking cam, and the eccentric is shaped in such a way that the locking cam and the locking wall contact at only one point in case there is no string in the channel.

2. String locking apparatus according to claim 1, characterized in that the beam includes further U-shaped channels, one for each string of the stringed instrument, and furthermore each channel includes its own locking cam and locking wall, so that for each string a locking apparatus is present.

3. String locking apparatus according to claim 1, characterized in that the beam is placed directly behind the top nut of a guitar.

4. String locking apparatus according to claim 1, characterized in that the locking wall of the U-shaped channel (channels) has a bevelled edge.

5. String locking apparatus according to claim 1, characterized in that the locking cam each have an opening (22) for fixation of the spring of each of the locking cams.

6. String locking apparatus according to claim 5, characterized in that the beam in each channel is provided with a cavity underneath each of the locking cams, so that the spring (30) for each locking cam can be completely inserted.

7. String locking apparatus according to claim 1, characterized in that the spring for each locking cam has a limited torque.

8. String locking apparatus according to claim 1, characterized in that the curvature of the eccentric depends on the type of string (plain or wound) that has to be locked by it.

9. String locking apparatus according to claim 1, characterized in that the locking cams are oriented substantially vertical relative to the beam.

10. String locking apparatus according to any of the preceding claims, characterized in that the locking cam is laser cut from spring steel.

11. String locking apparatus according to claim 1, characterized in that the beam is provided with one or two U-shaped channels, the beam being made from quench quality steel RUS and being quenched to approximately 60 HRc.

12. String locking apparatus according to claim 1, characterized in that the beam is provided with one or two U-shaped channels the beam being dimensioned in such a way that the distance between the channels corresponds with the standard spacing between the strings of the stringed instrument and the length of the beam does not exceed the width of the neck of the stringed instrument, to which the beam is mounted.

13. Stringed instrument including a string locking apparatus according to claim 1 and at the same time provided with a tremolo, fixed to the other side of the strings opposite the side anchored to the locking apparatus.

* * * * *